US005329989A

United States Patent [19]

Wilson

[11] Patent Number: 5,329,989

[45] Date of Patent: Jul. 19, 1994

[54] INDUCTION MELTING AND CASTING APPARATUS

[75] Inventor: John G. Wilson, Wishaw, Scotland

[73] Assignee: Consarc Engineering Limited, Bellshill, Scotland

[21] Appl. No.: 777,222

[22] Filed: Nov. 1, 1991

[30] Foreign Application Priority Data

May 4, 1989 [GB] United Kingdom ..... 8910266.9

[51] Int. Cl.[5] ..... B22D 11/10; B22D 41/00

[52] U.S. Cl. ..... 164/507; 164/335; 164/438; 164/513; 266/143; 266/276

[58] Field of Search ..... 164/507, 513, 335, 438; 266/143, 165, 276

[56] References Cited

U.S. PATENT DOCUMENTS 3,014,255 12/1961 Bussard et al. ..... 164/513 X 3,782,447 1/1974 Willim et al. ..... 164/438 X 4,502,527 3/1985 Brewer ..... 164/438 X

FOREIGN PATENT DOCUMENTS 58-84907 5/1983 Japan ..... 266/165

*Primary Examiner*—J. Reed Batten, Jr.

*Attorney, Agent, or Firm*—Pennie & Edmonds

[57] ABSTRACT

The apparatus includes casting stations disposed around a melt chamber of a furnace. Each casting station has a tundish for selectively transporting melt to the desired casting station. The apparatus is provided with apertures in the walls of the melting chamber to allow the tundishes to enter the melt chamber through fixed vacuum seals to receive molten metal from a tiltable melting unit and to convey the melt through the vacuum gate valve to the desired casting station.

7 Claims, 3 Drawing Sheets

INDUCTION MELTING AND CASTING APPARATUS

BACKGROUND OF THE INVENTION

The present invention relates to a melting and casting furnace particularly, but not exclusively, of the vacuum induction type.

Vacuum induction melting and casting furnaces are well known in the art. In this type of furnace melting is carried out under conditions of reduced pressure and heating is achieved by means of an induction coil. There are many different types of design. The simplest design is a single chamber system with a turntable in which the melting unit within the chamber is movable to pour into removable moulds situated on a turntable. With such a design, the chamber has to be opened for loading and unloading after each melt. An improvement of the single chamber design is achieved with a 2-chamber system separated by vacuum gate valves in which tundishes move between the 2 chambers to direct the melt from the melting unit into the mould and the mould assembly/array can be rotated by a turntable. The advantage of this design is that the melting chamber can still be closed and maintained under reduced pressure for a complete melt cycle. In another system a large mould chamber is isolated by vacuum gate valves with movable mould cars so that again the melting chamber can be maintained under reduced pressure for a complete melt cycle. In another design the entire mould chamber and turntable can be moved and the two chambers are separated by a vacuum gate valve so that one or more moulding chambers can be brought into position to receive the melt from the melting chamber.

In all of the aforementioned arrangements the melting chamber is fixed or else can move horizontally, but the melting unit is tiltable inside the melting chamber so that the melt can be poured either directly into the mould or more usually into a tundish which directs the melt to an assembly or array of moulds in turn. It will be understood that in the present specification, the term tundish is used to denote a collecting and pouring device of a type well known in the art and movable so as to convey and discharge molten metal, the term including any suitable device of this type, for example a launder or the like.

A different design of vacuum induction chamber is one in which the melt chamber and the melting unit are tilted together, the melt chamber is coupled to a mould chamber through a rotary vacuum seal and a movable launder which is usually resident in the mould chamber is fed through the rotary vacuum seal to receive the melt and direct the flow into the assembly or array of moulds. This system, although offering a degree of flexibility, results in a relatively complex furnace design and limits control over molten metal flow and filtration resulting in excessive turbulence with increased possibility of refractory inclusion. It is difficult to obtain satisfactory rotary vacuum seals, with the result that the problems can occur in attaining acceptable purity in cast ingots for certain types of materials. In addition rotary seals are complex, difficult to fabricate and maintain.

Perhaps the main problem with all aforementioned designs is that each system is not flexible enough to cope with the various casting processes required. Thus, if more that one type of casting process is required during a specific melting cycle then the whole furnace has to stop production for a different mould chamber to be coupled to the furnace. This introduces long shutdowns and the possibility of atmospheric pollution which can result in the contamination of the melt and the resultant cast product.

There has been proposed a two chamber system separated by a vacuum gate valve consisting of a horizontal melting chamber and mould chamber. In this concept the furnace change is allowed by utilising of two furnace inserts each being mounted on a swivel door. This is alleged to improve casting continuity and the casting of different kinds of melt. However, this arrangement does not solve the basic problem of allowing different types of casting processes without interrupting the complete operation and cycling of the furnace.

SUMMARY OF THE INVENTION

It is an object of the present invention to provide an improved vacuum induction melting and casting furnace which obviates or mitigates known disadvantages of the prior art described above.

This is achieved by disposing additional casting stations around the melt chamber and providing a separate tundish for each additional casting station for selectively transporting melt to the desired casting station. This is conveniently achieved by modifying an existing design of vacuum induction melting and casting furnace to create apertures in the walls of the melting chamber to allow the separate removable tundishes to enter the melt chamber through fixed vacuum seals to receive molten metal from the tiltable melting unit and to convey this through the vacuum gate valve to the desired casting station adjacent to the melt chamber. Conveniently there are two additional casting stations disposed laterally of the melt chamber.

According to one aspect of the present invention there is provided a vacuum induction melting and casting furnace comprising a melt chamber containing a melting unit for melting a material by induction under vacuum, a plurality of casting stations coupled to the melt chamber by valve means, said casting stations being disposed around the periphery of the melt chamber and each casting station having respective tundish means associated therewith which are adapted to be moved through respective valve means into said melt chamber so that, in use, a selected tundish means when disposed in said melt chamber receives melt from said melting unit and transfers said melt to its casting station and said casting stations are capable of being used for the same casting operation or different casting operations.

Preferably three casting stations are disposed around the periphery of the melt chamber. Conveniently two of the casting stations are disposed substantially perpendicular to the direction of the tilt of the melting unit so that the melt is transferred at substantially right angles to the direction of pour into said tundish means and into the appropriate casting station. Only one mould chamber at a time may be operational to said melt chamber. Although it is possible to cast from one melt into all three casting stations it is not intended to operate under such conditions unless under special conditions.

Conveniently one of the casting stations includes a mould turntable for rotating a plurality of different moulds into a position for receiving melt from the tundish means coupled to the melt chamber. Additionally one of the other casting stations includes an uphill mould teeming assembly for receiving melt when its particular tundish is connected to the melt station. One of the other casting stations may be coupled to a continuous casting furnace into which the molten metal is transferred and held before being cast into shapes and cropped into lengths.

In an alternative arrangement a powder atomising station may replace the uphill mould teeming assembly, the powder atomising station includes a movable tundish means for entering the melt chamber and for conveying melt to said powder atomising station.

These and other aspects of the invention will become apparent from the following description when taken in combination with the accompanying drawings in which.

Figure 1:
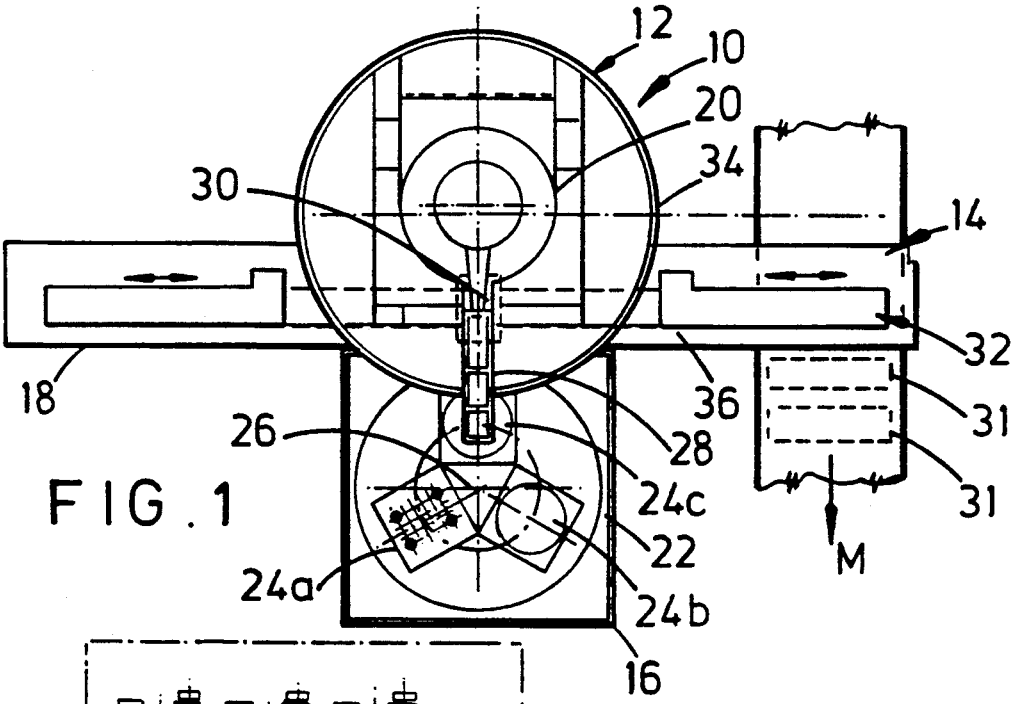
FIG. 1 is a diagrammatic plan view of an embodiment of a vacuum melting and induction furnace in accordance with the present invention depicting three casting stations disposed around a melt chamber at right angles.

Reference is first made to FIG. 1 of the drawings which depicts a plan view of a vacuum induction melting and casting furnace generally indicated by reference numeral 10. The furnace consists of a melting chamber 12 which is generally circular or rectangular in cross section and which has three casting stations 14, 16 and 18 disposed substantially at right angles to each other about the circumference of the chamber 12 for selectively transferring the melt from the melt chamber to a selected casting station to be later described in detail.

The melt chamber 12 is generally cylindrical or rectangular in shape and contains a generally cylindrical melting unit 20 which can be tilted to pour molted liquid from the melting unit into tundishes to transfer the molten material into a particular casting station as desired. The melt chamber and melting unit are standard in the art. Casting station 16 contains a mould turntable 22 on which are mounted three different types of moulds 24*a*, 24*b* and 24*c* and the turntable is rotatable about axis 26. Melt chamber 12 is coupled to casting station 16 through a vacuum gate valve (not shown in the interest of clarity) which is openable to define an aperture so that a movable tundish 28 can be moved along the tundish chamber 29 between the casting station 16 and the melt chamber 12. The tundish 28 is of a type standard in the art and is basically an elongated trough with weirs, baffles and filters, which, when moved into the melt chamber 12, is disposed beneath spout 30 of the melting unit for guiding molten liquid poured into the tundish along the tundish into the casting station disposed at the opposite end of the tundish; in the diagram the casting station is shown with mould assembly 24*c*positioned for filling. It will be appreciated that once the mould assembly 24*c* is filled the turntable is rotated so that assemblies 24*a* and 24*b* can then also be filled.

In FIG. 1, casting stations chambers 14 and 18 are shown to be identical and in the interest of clarity only station 14 will be described in detail, although it will be understood that the description also applies to casting station 18.

Casting chamber 14 for example can accommodate a continuous casting furnace chamber whereby cast bars or tubes are passed through the chamber in the direction of arrow M. A tundish 32 is disposed in station 14 and is generally L shaped in plan. The tundish is movable through an aperture 34 so that the leading end 36 of the tundish lies beneath the spout 30 for transferring melt from the melting unit 20 to continuous casting furnace 31.

When the tundish is retracted into the casting station 14, as shown in solid outline, the aperture 34 is sealed by a valve (not shown in the interest of clarity) and when required this valve is opened so that the tundish is moved into the melt chamber 12 (as shown in broken outline) so that the leading end lies beneath the spout 30.

Figure 2:
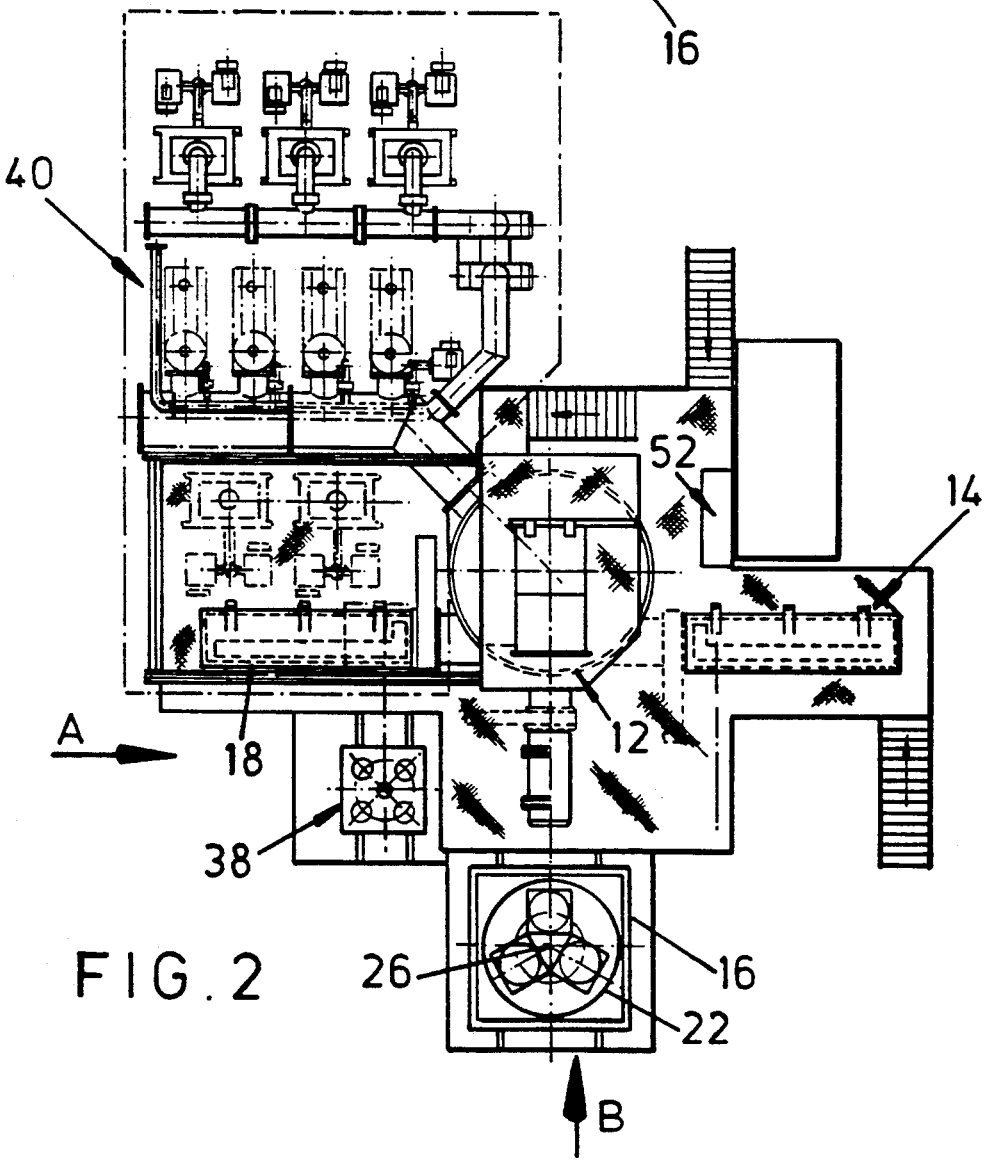
FIG. 2 depicts a plan view of a proposed layout of a complete vacuum induction and casting furnace incorporating the design shown in FIG. 1.
Figure 3:
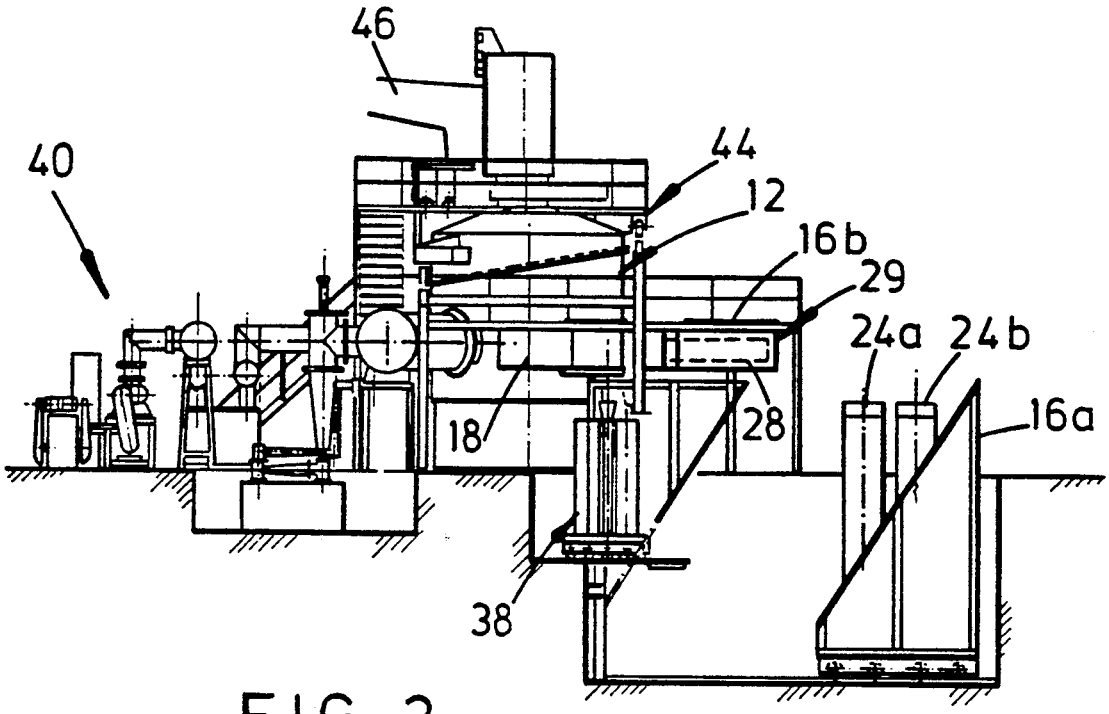
FIG. 3 is a side elevation of the vacuum induction and melting furnace shown in FIG. 2 taken in the direction of arrow A.
Figure 4:
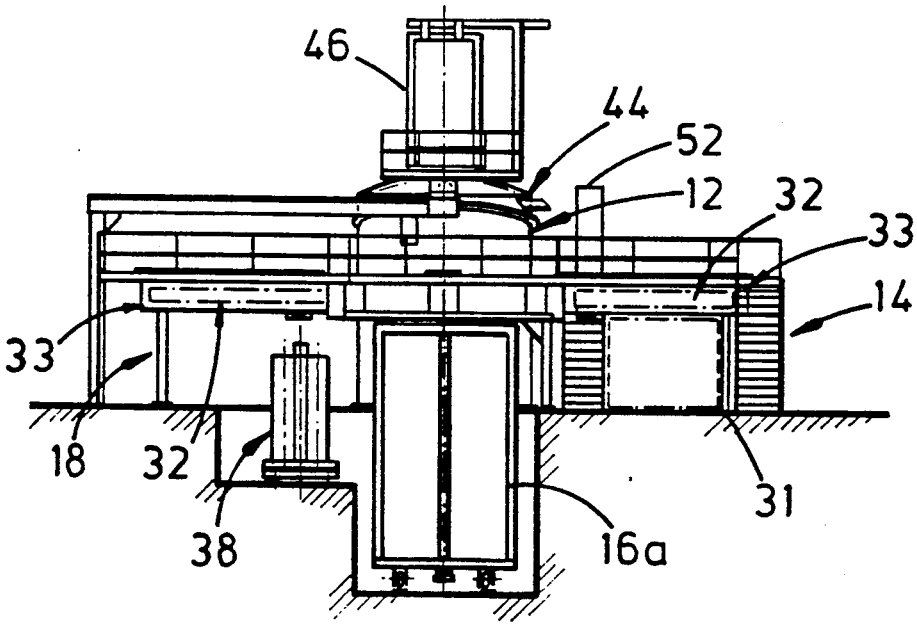
FIG. 4 is an elevation of the furnace shown in FIG. 2 taken in the direction of arrow B.

Reference is also made to FIGS. 2, 3 and 4 of the drawings which are more detailed plan elevational end views of the vacuum induction melting and casting unit when incorporated in a complete furnace assembly. From the drawings it will be seen that the casting station 18 is adapted to receive a set of uphill teeming moulds 38 which can be slid into the position shown. It will also be seen that the melt chamber 12 is coupled to a vacuum pumping and filter system generally indicated by reference numeral 40 for creating the necessary vacuum conditions inside a furnace to achieve the necessary quality of ingot. Also an induction power supply which is coupled to the induction coil not shown in the interest of clarity, disposed around the melting unit as is standard in the art to permit the charge within the melting unit to be melted.

As best seen in FIGS. 3 and 4 the cylindrical melt chamber 12 has a top roll-away lid 44 to permit a charge to be introduced to the melting unit via charging chamber 46. The casting station 16 is split as shown into two parts; a movable part 16*a*, containing the turntable and mould and a fixing part 16*b*, which is disposed beneath tundish chamber 29 which houses movable tundish 28. Similarly movable uphill mould teeming assembly 38 is movable into register with the tundish chamber 33 which houses movable tundish 32. This is also the case with continuous casting furnace at the casting station 14 disposed in the opposite side of the melt chamber 12.

The arrangement is such that, in use, the roll-away lid is opened to allow servicing of the melting unit, as is standard in the art. The lid is then replaced and the melt chamber is evacuated and a charge from the charging chamber 46 to be deposited in the melting unit 44 is melted and refined in accordance with standard procedures. In order to pour some of the molten charge into moulds 24*a*, 24*b* and 24*c*, the casting station part 16*a* is brought into register with part 16*b*, evacuated and the vacuum valve is opened to allow the tundish 28 to move through the aperture so that its leading end is disposed to receive melt poured from the melting unit 20. The molten material is conducted along the tundish and into the moulds 24*a*, 24*b* and 24*c* as appropriate. When the moulds are filled as desired the tundish 28 is retracted and the valve closed. When the next batch of molten charge is ready to be dispensed to another of the casting stations, for example, the uphill mould teeming assembly 38 in casting station 18, assembly 38 is brought into register with the tundish chamber 33 and the vacuum valve is opened to allow the tundish 32 to pass through the aperture 34 so that the leading end is disposed beneath spout 30 for receiving molten material poured from the melting unit 20. This molten material is then conducted to the uphill mould teeming assembly 38 in accordance with standard techniques. Once the uphill mould teeming assembly has received the required amount of molten liquid the tundish is retracted and the valve closed. This procedure can be repeated for the continuous casting furnace in the casting station 14.

It will be appreciated that the casting stations can be selected as required in any order to receive the charge from the melting unit 20.

Figure 5:
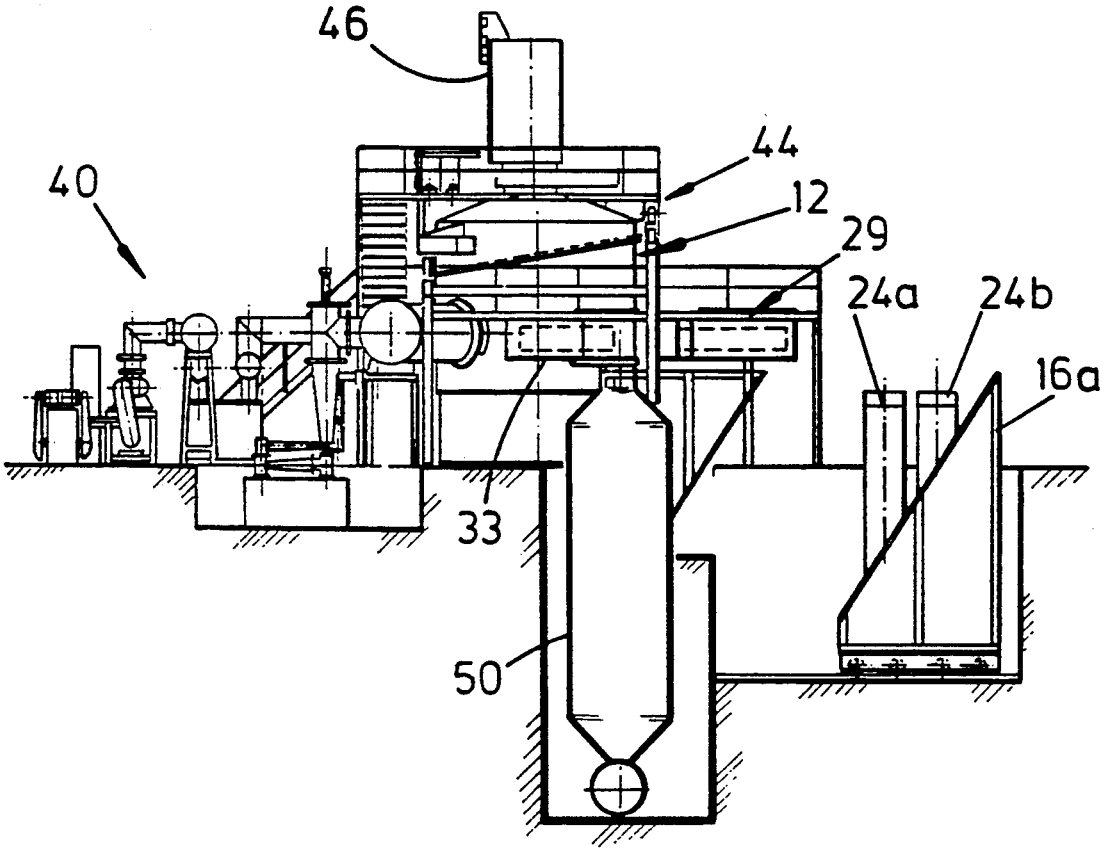
FIG. 5 is a view similar to FIG. 3 with a powder atomising chamber replacing the uphill mould teeming assembly shown in FIG. 3.

FIG. 5 shows an alternative arrangement in which the uphill mould teeming assembly has been replaced by a powder atomising chamber which is of greater depth because of the nature of the powder atomising process and is disposed in a deeper excavation in the floor in accordance with standard technology. In this case like numerals denote like parts and the powder atomising chamber 50 is disposed beneath the tundish chamber 33 for receiving melt in the same way as uphill mould teeming assembly 38.

There is provided a control station generally indicated by reference numeral 52 which permits an operator to control the sequence of pouring into the mould chambers selected as appropriate using the apparatus and procedure as described above.

Various modifications would be made to the vacuum induction melting and casting furnace hereinbefore described without departing from the scope of the invention. For example, although three casting stations are shown coupled to the melting chamber it will be appreciated that only two such casting stations may be coupled, or alternatively more than three casting stations may be coupled, although it will be understood that this may require longer tundishes and that the practical length of the tundishes may be determined by the temperature to be achieved in the metal being melted. The basic furnace can be modified so that any suitable type of casting station such as turntable station, or continuous casting, an uphill mould teeming assembly or powder atomising furnace may be connected as described above or for example a plurality of turntable moulding stations may be connected. The furnace is of course suitable for melting, treating and casting of super alloys and high grade steels under vacuum or in an inert gas atmosphere. Non-ferrous materials can also be used and furnace may have applications in degassing of special steels and non-ferrous materials for the foundry industry.

An advantage of the present invention is that the furnace can be set up so that a continuous casting station, mould filling station with rotary mould turntable or mould trolley, uphill teeming station, and other different modes of casting vacuum melting materials which may normally be required, can be incorporated without the need to interrupt the standard operation of a vacuum melting and casting furnace for long periods of time due to shut down.

In addition the basic furnace has straightforward control of valves and tundishes and is readily modified by the provision of additional casting processes for centrifugal casting and investment casting of large moulds. The invention is based on proven reliable technology, offers increased flexibility and removes the requirement for rotary vacuum seals. The invention further increases the reliability and flexibility, minimising the expense of the vacuum induction melting and casting furnaces.

With the increasing demand of materials requiring to be vacuum melted the invention provides the flexibility to have a number of casting stations situated around the one vacuum melting chamber thereby minimising the expense and requirement for multiple vacuum induction melting and casting units.

I claim:

1. A vacuum induction melting and casting apparatus comprising a melt chamber containing a melting unit for melting a material by induction under vacuum, a plurality of casting stations coupled to the melt chamber by valve means, said casting stations being disposed around the periphery of the melt chamber and each casting station having respective tundish means associated therewith which are adapted to be moved through respective valve means into said melt chamber so that, in use, a selected tundish means when disposed in said melt chamber receives melt from said melting unit and transfers said melt to its casting station and said casting stations are capable of being used for the same casting operation or different casting operations.

2. The apparatus as claimed in claim 1 wherein three casting stations are disposed around the periphery of the melt chamber.

3. The apparatus as claimed in claim 1 wherein two of the casting stations are disposed substantially perpendicular to the direction of the tilt of the melting unit so that the melt is transferred at substantially right angles to the direction of pour into said tundish means and into the appropriate casting station.

4. The apparatus as claimed in claim 1 wherein one of the casting stations includes a mould turntable for rotating a plurality of different moulds into a position for receiving melt from the tundish means coupled to the melt chamber.

5. The apparatus as claimed in claim 1 wherein one of the other casting stations includes an uphill mould teeming assembly for receiving melt when its associated tundish means is connected to the melt chamber.

6. The apparatus as claimed in claim 1 wherein one of the other casting stations is coupled to a continuous casting furnace into which the melt is transferred and held before being cast into shapes and cropped into lengths.

7. The apparatus as claimed in claim 1 wherein one of the other casting stations includes a powder atomising station, the powder atomising station including one of said tundish means for entering the melt chamber and for conveying melt to said powder atomising station.

* * * * *